US006761671B1

(12) United States Patent
McKinney et al.

(10) Patent No.: US 6,761,671 B1
(45) **Date of Patent: *Jul. 13, 2004**

(54) EXERCISE SYSTEM COMPRISING ROCKING CHAIR AND FOOTSTOOL

(75) Inventors: William M. McKinney, Winson-Salem, NC (US); Ralph W. Barnes, Winston-Salem, NC (US)

(73) Assignee: Wake Forest University, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/690,124

(22) Filed: Oct. 16, 2000

Related U.S. Application Data

(63) Continuation of application No. 08/936,175, filed on Sep. 24, 1997, now Pat. No. 6,132,342.

(51) Int. Cl.[7] ..... A63B 21/06
(52) U.S. Cl. ..... 482/93; 482/95; 482/133
(58) Field of Search ..... 297/271.6, 423.35, 297/423.45, 423.46, 217.3; 482/909, 130, 142, 93, 95, 133, 145

(56) References Cited

U.S. PATENT DOCUMENTS

| | | | | |
|---|---|---|---|---|
| 1,344,255 A | | 6/1920 | Beckman et al. | 482/145 |
| 2,644,688 A | * | 7/1953 | Roberge | 482/130 |
| 4,109,960 A | * | 8/1978 | Stinchfield | 297/217.3 |
| 4,705,268 A | * | 11/1987 | Nadeau | |
| 4,997,234 A | * | 3/1991 | Royle et al. | 297/58 |
| 5,242,354 A | * | 9/1993 | Seith, Jr. | 482/130 |
| 5,300,005 A | | 4/1994 | Wang | 482/97 X |
| 5,419,618 A | | 5/1995 | Hatcher | 297/423.45 |
| 5,554,086 A | | 9/1996 | Habing et al. | 482/96 X |
| 5,595,558 A | | 1/1997 | Moon | 482/95 X |
| 6,132,342 A | * | 10/2000 | McKinney et al. | 482/93 |

FOREIGN PATENT DOCUMENTS

| | | | | |
|---|---|---|---|---|
| DE | 3432303 | * | 5/1983 | 297/277.3 |
| DE | 3544402 | | 9/1986 | 297/270.1 |

* cited by examiner

*Primary Examiner*—Jerome W. Donnelly
(74) *Attorney, Agent, or Firm*—Neils Haun; Dann, Dorfman, Herrell and Skillman, P.C.

(57) ABSTRACT

An exercise system comprising a rocking chair and a footstool. The rocking chair comprises a seat, a back support, a base, and rocking means. Rocking resistance means are provided for requiring that an additional force be applied to the rocking chair to maintain a rocking motion. The footstool comprises a foot rest positionable with respect to the rocking chair such that the feet of a user are supported on a foot support surface of the foot rest when the user is seated upon the rocking chair. Means for adjusting the height and angle of the foot rest are also provided. A method for selectively exercising specific muscle groups in a user's legs with the exercise system is also described.

9 Claims, 6 Drawing Sheets

EXERCISE SYSTEM COMPRISING ROCKING CHAIR AND FOOTSTOOL

RELATED APPLICATIONS

This application is a continuation of U.S. application Ser. No. 08/936,175, filed Sept. 24, 1997 now U.S. Pat. No. 6,132,342, such application being incorporated herein by reference.

FIELD OF THE INVENTION

The present invention relates to a rocking chair and, more specifically, to a rocking chair and foot rest which provide enhanced therapeutic benefits.

BACKGROUND OF THE INVENTION

Although rocking chairs are typically used in social settings, the rocking motion can be beneficial as a form of exercise. In particular, rocking chairs can provide a valuable mode of exercise for residents of retirement or minimum to medium care facilities. Residents of retirement or minimum to medium care facilities often do not exercise, even moderately, due to lack of motivation, suitable exercise equipment, and/or a supportive community to encourage exercise. Although specialized exercise equipment has been used in the care of the elderly for many years, most equipment is associated with physical therapy or other scheduled exercise sessions.

Exercising while relaxing in pleasant surroundings and engaging in social activities in a supportive group has advantages. Participants can exercise while not feeling exercised and can conduct their social activities at the same time. In addition, the physical exertion and the awareness of the passage of time becomes secondary, as attention is diverted away from the exercise by their social activities at the time. Further, these social activities occur daily and would therefore encourage daily exercise.

An exercise system incorporating the use of a rocking chair affords a unique opportunity for exercise to be performed in a relaxed, casual environment. However, by itself, rocking in a conventional rocking chair results in only very light exercise. Leg action in a rocking chair is limited by the person's leg length compared to the height and depth of the rocking chair seat. Most people need the majority of their leg and foot length just to reach the floor, leaving very little leg extension reserve for the rocking motion. The soles of the feet often just reach the floor so that rocking is accomplished by raising the heels and pushing with the balls of their feet. Accordingly, a person may only push off the floor with their feet and not benefit from any exercise potential of the rocking chair. In addition, the thighs are flat against the seat which restricts exercise motion and effort in the thigh muscles.

Further, conventional rocking chairs are designed to facilitate the rocking motion. Accordingly, conventional rocking chairs comprise a rocking means, such as rockers or other devices that work with a rocking motion, that minimizes the effort required to maintain a rocking motion. As a result, the use of conventional rocking chairs produces only minimal fitness benefits.

The exercise potential of conventional rocking chairs is also limited since many people find that the known rocking chairs are not comfortable for a variety of reasons. First, the user's legs are often not long enough to comfortably reach the floor and produce a satisfying rocking motion. The rocking motion is therefore not under the user's control as much as if the feet remained in contact with the floor throughout the entire rocking cycle. Many people prefer to have their feet in contact with the floor, both for comfort and control of the rocking motion. Second, after a time, the user's body tends to slide away from the back of the rocking chair resulting in discomfort. As the body slides away from the back of the rocking chair, the user's body takes on a slouched position which tends to be uncomfortable. In light of the foregoing, the user is unable to maintain the rocking motion for extended periods of time in conventional rocking chairs.

Although footstools have been used in connection with rocking chairs for comfort and to elevate the feet, the known footstools cannot be adjusted to yield maximal exercise benefit by providing optimal comfort and a more vigorous rocking motion. Further, as the user continues to rock, the known footstools tend to slide along the ground and do not help to keep the user's body against the back of the chair. As a result, the user may feel less secure and relaxed. Although footstools of different heights have been used, the problems persist.

In light of the foregoing, it would be highly beneficial to utilize a rocking chair as part of an exercise program. To optimize the exercise benefits, the rocking chair should be provided with means for controlling the effort needed to maintain the rocking motion. In addition, the user's feet should be maintained in contact with a stationary surface throughout the rocking cycle, the rocking cycle should start with the thighs and calves at about right angles, and body contact should be maintained with the back of the rocking chair.

SUMMARY OF THE INVENTION

In accordance with the present invention, an exercise system comprising a rocking chair is provided for enhancing the therapeutic benefits derived from use of the rocking chair. The rocking chair comprises a seat with a back support positioned relative to the seat such that when a user sits on the seat, the user's back is positioned against the back support. The seat and back support are maintained above the ground by a base or frame. Rocking means are positioned below the base or frame for enabling the chair to maintain a rocking motion. The rocking means may comprise one or more rockers having a curved surface, whereby the rocking chair is capable of being rolled along the curved surface of the rocker in a smooth rocking motion. Alternatively, the rocking means can comprise other known devices for producing a rocking or lilting motion, such as platform rockers, spring-based rocking systems, and linear motion gliders.

The therapeutic nature of the exercise system is enhanced by providing the rocking chair with rocking resistance means. The rocking resistance means comprises one or more weights which are attached to the rocking chair. The weights insure that the force required to maintain a rocking motion contains an additional force beyond the typical force necessary to maintain a rocking motion in a conventional rocking chair. The weights can be attached to the rocking chair either by positioning the weights over a bar or by clamping the weights to the rocking chair.

To further enhance the therapeutic nature of the exercise system, a footstool is provided. The footstool comprises a foot rest which is positionable with respect to the rocking chair such that the feet of a user are supported on a foot support surface of the foot rest when the user is seated upon the rocking chair. The footstool further comprises means for adjusting the height and angle of the foot rest. By adjusting the position of the footstool with respect to the rocking chair, the height of the footstool, and the angle of the footstool, it is possible to selectively emphasize the exercise of specific muscle groups in the leg.

A method for selectively exercising specific muscle groups in a subject's legs is also described. The method comprises the step of adjusting a rocking resistance means of an exercise system comprising a rocking chair to require an additional force to be applied to the rocking chair to maintain a rocking motion. The subject is then seated in the rocking chair and allowed to move the chair in a rocking motion by extending and flexing his or her legs. The comfort of the subject and the therapeutic benefits of the exercise system are enhanced by positioning and maintaining the subject's feet on a foot rest of a footstool throughout the rocking motion. The position of the footstool with respect to the rocking chair, as well as the height and angle of the foot rest, are adjusted to selectively exercise specific muscle groups in the subject's legs. For example, the footstool and foot rest can be adjusted to selectively emphasize the exercise of either the subject's calf or thigh muscles.

BRIEF DESCRIPTION OF THE DRAWINGS

The foregoing summary, as well as the following detailed description of the preferred embodiments of the present invention, will be better understood when read in conjunction with the accompanying drawings, in which.

DETAILED DESCRIPTION OF THE PREFERRED EMBODIMENTS

Figure 1:
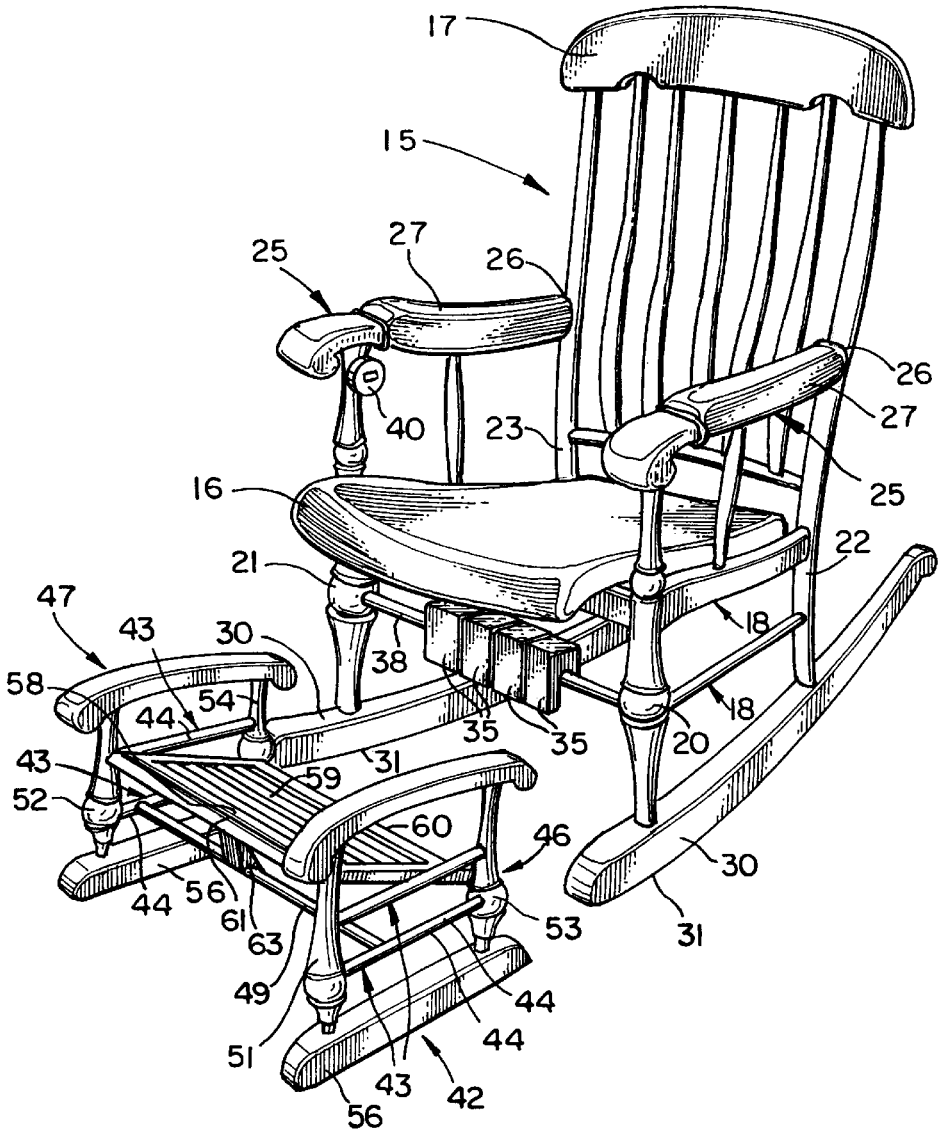
FIG. 1 is a perspective view of a rocking chair and footstool in accordance with the present invention.

An exercise system in accordance with the present invention is shown in FIG. 1. The exercise system comprises a rocking chair 15 having a seat 16 and a back support 17. The back support 17 is positioned relative to the seat 16 such that when a user is seated in the seat 16, the user's back rests against the back support 17. The seat 16 and back support 17 are maintained at a predetermined height with respect to the ground by a base or frame 18.

The frame 18 comprises four vertical posts or legs, 20–23, positioned at or near the corners of the seat 16. The posts, 20–23, extend away from the seat 16 toward the ground to thereby support the seat 16 and back support 17 above the ground. As can be readily seen, the lengths of the posts, 20–23, extending below the seat 16 determine the height of the seat 16. As shown in FIG. 1, the left and right rear posts, 22 and 23, extend above the seat 16 and are integrally formed as part of the back support 17.

Arm rests 25 are optionally provided to enable the user to comfortably rest his or her arms on the arm rests 25 while the user is seated in the rocking chair 15. Toward that end, the left and right front posts, 20 and 21, are extended to project above the seat 16 for securing the arm rests 25 relative to the seat 16. A rear portion 26 of each arm rest 25 is secured to the back support 17 in order to better stabilize the arm rests 25. Further, padded sections 27 can be provided on the arm rests 25 for the user's comfort.

Two curved rockers 30 are provided for enabling the rocking chair 15 to move in a rocking motion. One of the rockers 30 is affixed to the posts, 21 and 22, at the left edge of the seat 16 to extend from the front to the rear of the chair 15 with the curved surface 31 of the rocker 30 oriented downwardly. The other rocker 30 is similarly affixed to the posts, 21 and 23, at the right edge of the chair 15. Accordingly, the chair 15 is capable of being rolled simultaneously along the curved surfaces 31 of the two rockers 30 in a smooth rocking motion.

Figure 11:
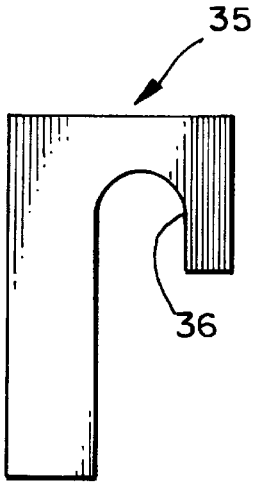
FIG. 11 is a side plan view of a weight as shown in FIG. 1.

To increase the effort needed to produce and maintain a rocking motion with the rocking chair 15 and thereby increase the therapeutic benefits of the chair 15, weights 35 are attached to the rocking chair 15. The weights 35 are attached to the chair 15 by positioning the weights 35 on a bar 38 which extends between the posts, 20 and 21, at the left and right front corners of the chair 15. Toward that end, the weights 35 are shaped to enable the weights 35 to be easily placed on, maintained in position about, and removed from the bar 38. As shown in FIG. 11, each weight 35 comprises a generally rectangular block of a dense material, such as iron, having a notch 36. The notch 36 is shaped to mate with the round bar 38 so that the weights 35 can be easily and reversibly positioned over the bar 38. The weights 35 provide resistance which counteracts the force necessary to create the rocking motion. Accordingly, the user is required to apply more force in order to sustain the rocking motion.

A counter 40 is affixed to the chair 15 in a position which is readily viewed by the user while seated in the rocking chair 15. The counter 40 provides the user with information regarding the number of rocking cycles completed and/or the length of time that the user has been rocking. As shown, the counter 40 is attached to one of the legs, 20–23, of the chair 15.

The exercise system further comprises a footstool 42. The footstool 42 comprises a generally rectangular frame 43 having side bars 44 positioned along the left and right sides, 46 and 47 respectively, of the footstool 42. A transverse strut 49 extends between one of the side bars 44 at the left side 46 of the footstool 42 and one of the side bars 44 at the right side 47 of the footstool 42.

Four vertical posts or legs, 51–54, are positioned at or near the corners of the frame 43. The posts, 51–54, extend toward the ground to support the frame 43 above the ground. As can be readily seen, the lengths of the posts, 51–54, determine the height of the frame 43. Feet 56 are provided at the ends of the posts, 51–54, nearest the ground to stabilize the footstool 42. The feet 56 also serve as an impediment to sliding by increasing friction between the footstool 42 and the ground. One of the feet 56 interconnects the two posts, 52 and 54, at the right side 47 of the footstool 42 and the other foot 56 interconnects the two posts, 51 and 53, at the left side 46 of the footstool 42.

The footstool 42 further comprises a foot rest 58, positioned on the frame 43, for providing a surface 59 upon which the user's feet may be placed while seated in the chair 15. The rear end 60 of the foot rest 58 is pivotally attached to the left and right rear posts, 53 and 54, so that the foot rest 58 can pivot about a pivot axis parallel to the ground. Accordingly, the height of the forward end 61 of the foot rest 58 above the ground can be adjusted by pivoting the foot rest 58 about the pivot axis. A restraining bar or catch 63 is used to restrain the foot rest 58 from pivoting. As shown in FIG. 1, the restraining bar 63 is wedged between the forward end 61 of the foot rest 58 and the transverse strut 49. Toward that end, the restraining bar 63 has a notch which is shaped to mate with the transverse strut 49 thereby preventing the restraining bar 63 from inadvertently disengaging from the transverse strut 49. Varying the length of the restraining bar 63, varies the height of the forward end 61 of the foot rest 58 above the ground and, hence, the slope from the forward end 61 toward the rear end 60 of the foot rest 58.

In operation, the user attaches an appropriate amount of weight to the chair 15 by positioning one or more weights 35 over the bar 38. Preferably, a series of weights 35 having different masses are provided to allow the user to vary the weight over a broad range. The footstool 42 is then positioned in front of the chair 15 with the rear end 65 of the footstool 42 nearest the chair 15. The user then sits in the chair 15 with his or her back against the back support 17. The user's feet are then placed on the foot rest 58 of the footstool 42. The angle of the foot rest 58 and the distance between the footstool 42 and the chair 15 are then adjusted for the user's maximum comfort and to provide adequate leg extension for the rocking motion. Specifically, the footstool 42 is adjusted such that the user's feet maintain contact with the upper surface 59 of the foot rest 58 throughout the rocking cycle, the rocking cycle starts with the user's thighs and calves at about right angles, and body contact is maintained with the back support 17 of the rocking chair 15. In addition, the exercise of specific muscle groups can be emphasized by varying the position of the footstool 42 with respect to the chair 15, as well as the height and angle of the foot rest 58. For example, the height and angle of the foot rest 58 and the position of the footstool 42 can be selected to emphasize the exercise of the calf muscles or the thigh muscles, including the quadriceps and hamstrings. The user then maintains a rocking motion for a predetermined number of rocking cycles or length of time. Alternatively, the user can continue to rock for as long a period of time as the user's fitness level will allow.

Figure 2:
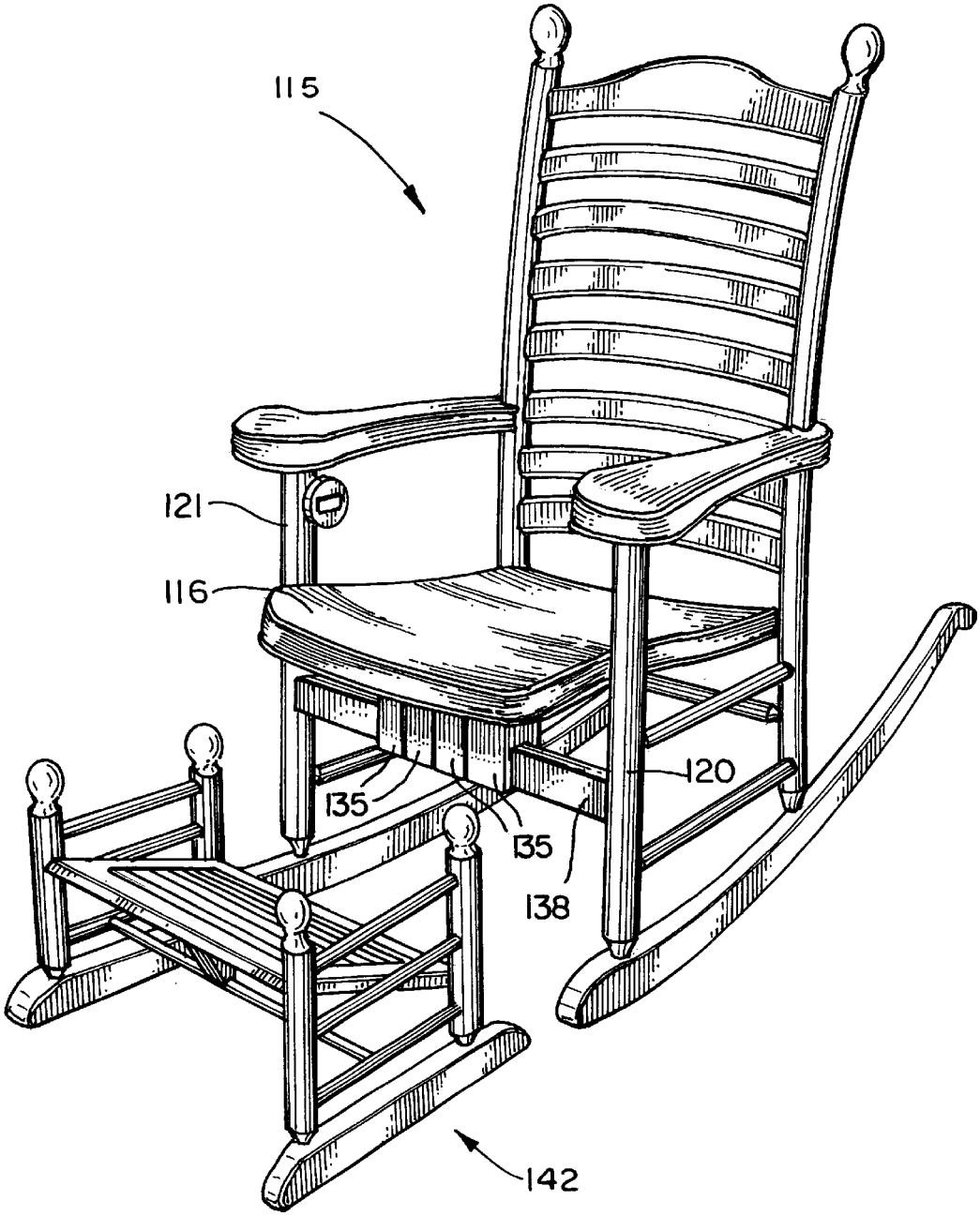
FIG. 2 is a perspective view of a second embodiment of a rocking chair and footstool in accordance with the present invention.
Figure 12:
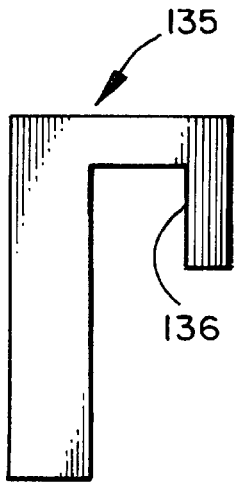
FIG. 12 is a side plan view of a weight as shown in FIG. 2.

A second embodiment of an exercise system in accordance with the present invention is shown in FIG. 2. The rocking chair 115 and footstool 142 in FIG. 2 are in many respects identical to the rocking chair 15 and footstool 42 of FIG. 1, except for differences in aesthetic design. However, the bar 138 which extends between the posts, 120 and 121, at the left and right front corners of the chair 115 is a rectangular bar, as opposed to the round bar 38 of the embodiment shown in FIG. 1. Accordingly, as shown in FIG. 12, the notch 136 provided in each of the weights 135 is shaped to mate with the rectangular cross-section of the bar 138. The use of rectangular bar 138 helps to insure that the weights 135 do not rotate about the bar 138 as the chair 115 is rocked. Further, in the embodiment of FIG. 2, the seat 116 is provided with padding to enhance the comfort level of the user, thereby enabling the user to maintain the rocking motion for longer periods of time.

Figure 3:
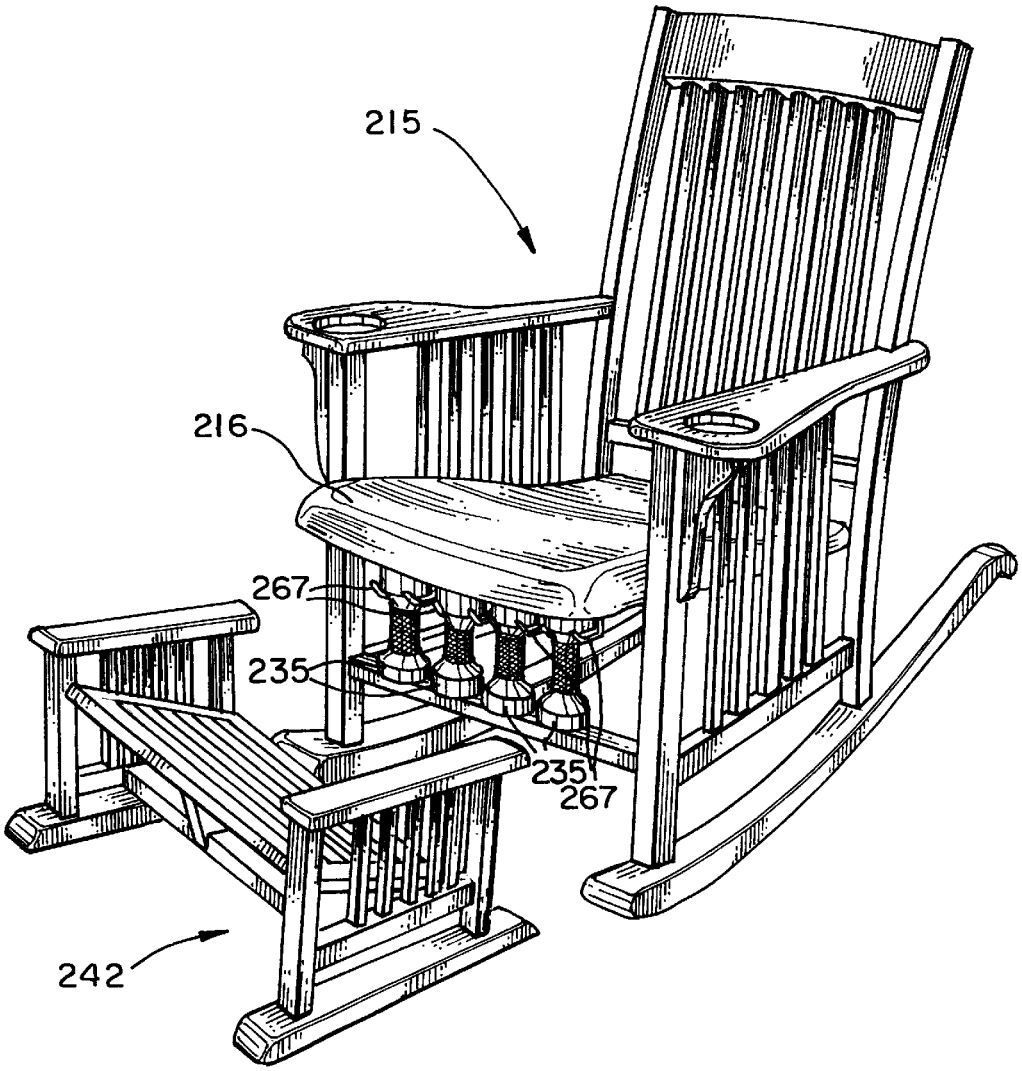
FIG. 3 is a perspective view of a third embodiment of a rocking chair and footstool in accordance with the present invention.
Figure 5:
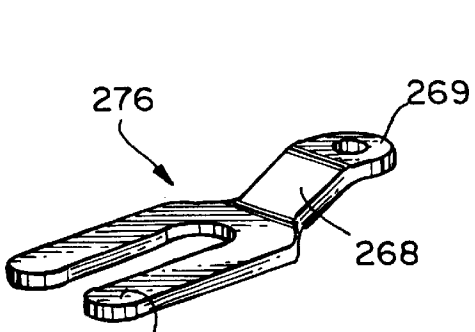
FIG. 5 is a perspective view of a clamp as shown in FIG. 3.
Figure 4:
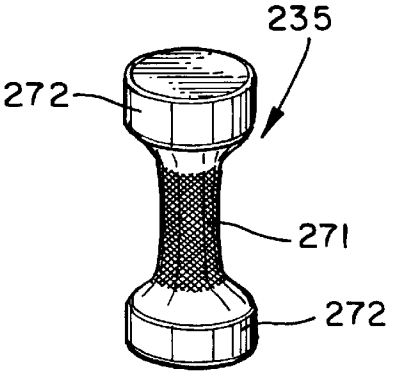
FIG. 4 is a perspective view of a weight as shown in FIG. 3.

A third embodiment of an exercise system in accordance with the present invention is shown in FIG. 3. The rocking chair 215 and footstool 242 in FIG. 3 are in many respects identical to the rocking chair 15 and footstool 42 of FIG. 1, except for differences in aesthetic design. However, the weights 235 are attached to the chair 215 using one or more clamps 267. A clamp 267 in accordance with the present invention is shown in FIG. 5. The clamp 267 comprises an angled bar 268 with an eyelet 268 positioned at one end and a U-shaped clasp 270 at the other end. The eyelet 269 is designed to enable the clamp 267 to be attached to the bottom surface of the seat 216 by, for example, a nail or screw. The clasp 270 is used to securely, but releasably, hold a weight 235. Accordingly, the weight 235 is shaped to mate with the U-shaped clasp 270. As shown in FIG. 4, the weight is essentially dumbbell shaped having a generally cylindrical portion 271 with a widened section 272 at each end. The angle of the bar 268 and the width of the widened sections 272 are selected such that the cylindrical section 271 of the weight 235 can be held by the U-shaped clasp 270 of the clamp 267 when the clamp 267 is attached to the seat 216.

Figure 6:
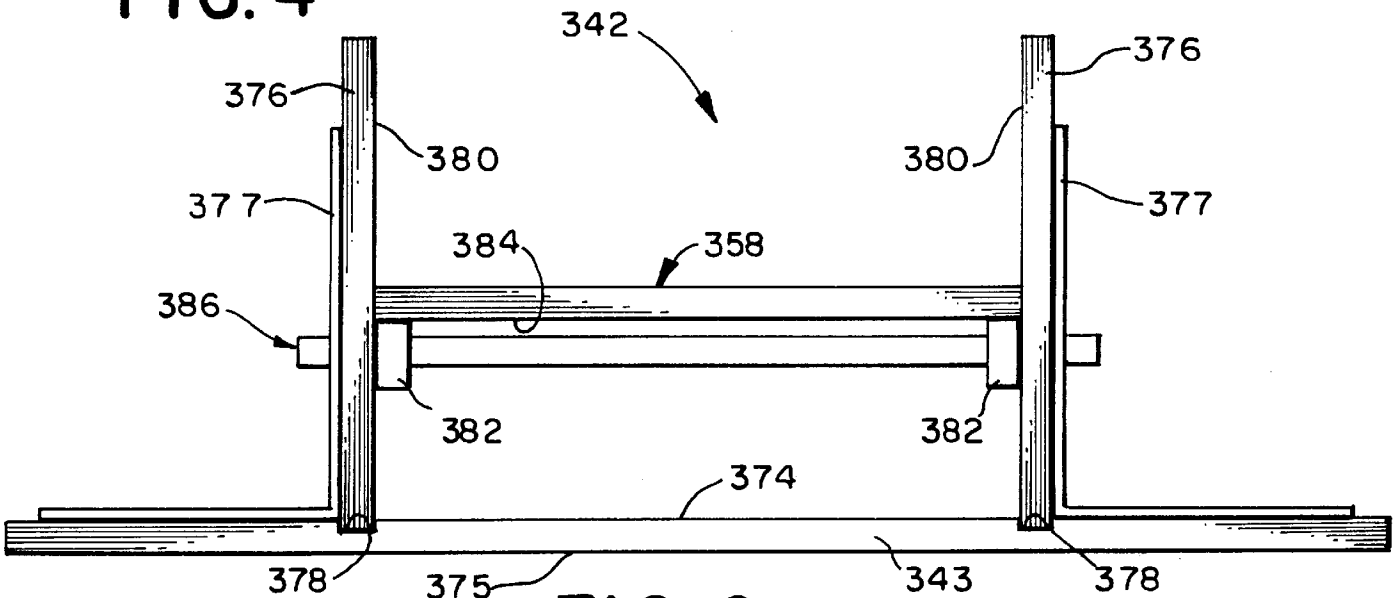
FIG. 6 is a front end view of an alternate embodiment of a footstool in accordance with the present invention.

An alternate embodiment of a footstool 342 in accordance with the present invention is shown in FIG. 6. The footstool 342 comprises a base 343 in the form of a generally rectangular plate. When the footstool 342 is in use, a bottom surface 375 of the base 343 is in contact with the ground, thereby increasing friction between the footstool 342 and the ground.

Figure 7:
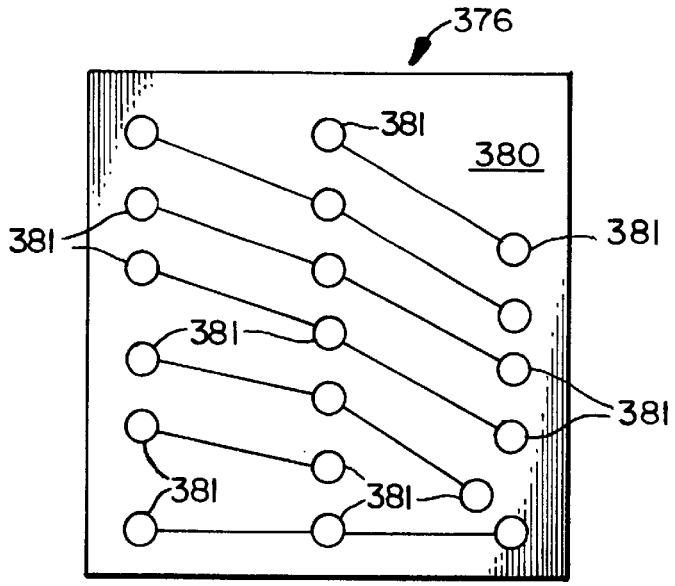
FIG. 7 is a side plan view of an inner surface of an end piece of the footstool shown in FIG. 6.

End pieces 376, in the form of generally rectangular plates, are attached to the base 343 by brackets 377. The end pieces 376 are positioned at right angles to the base 343 with the end pieces 376 being generally parallel and spaced apart. Grooves 378 can be provided in a top surface 374 of the base 343 for additional support to maintain the end pieces 376 in place. As shown in FIG. 7, an inner surface 380 of the end pieces 376 comprises a plurality of bores 381. Further, the bores 381 of one of the end pieces 376 are arranged in a mirror-image pattern to the bores 381 of the other end piece 376. Accordingly, each bore 381 on one of the end pieces 376 is diametrically opposed and aligned with one of the bores 381 on the other end piece 376.

Figure 8:
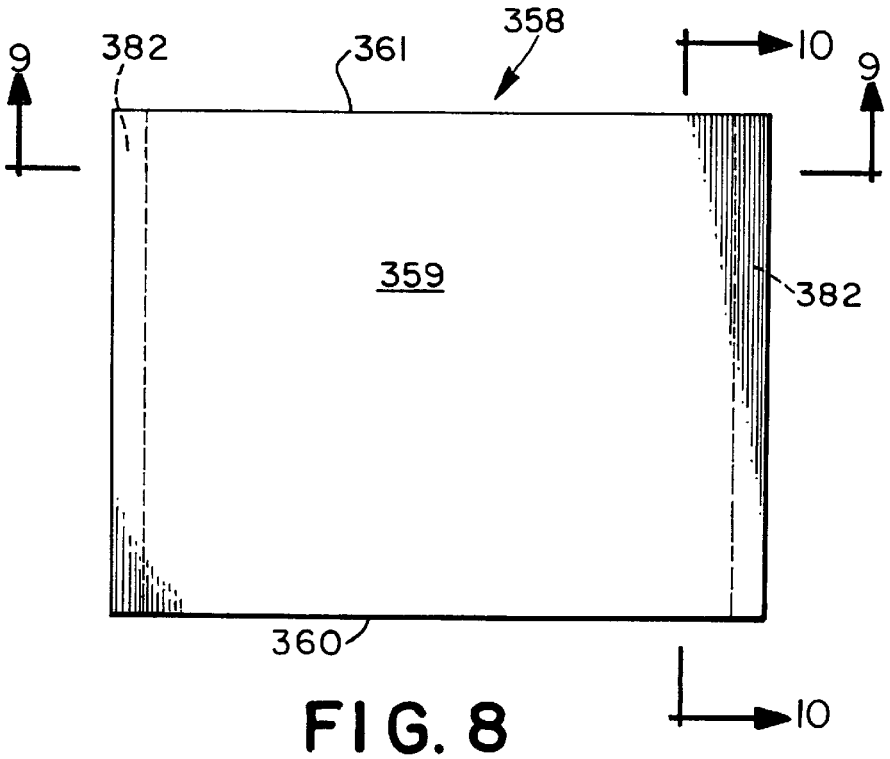
FIG. 8 is a top plan view of a foot piece of the footstool shown in FIG. 6.
Figure 10:
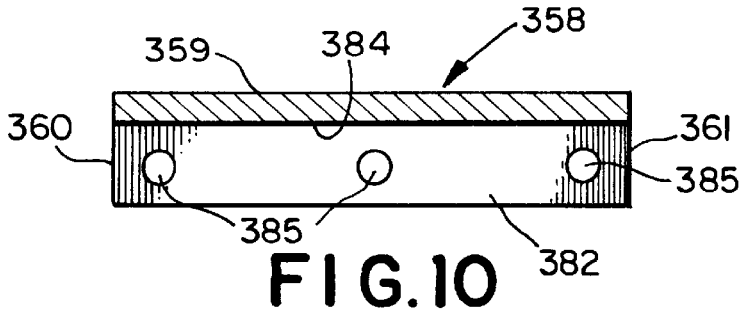
FIG. 10 is a cross-sectional view of the foot piece shown in FIG. 8 taken along the 10—10 line.
Figure 9:
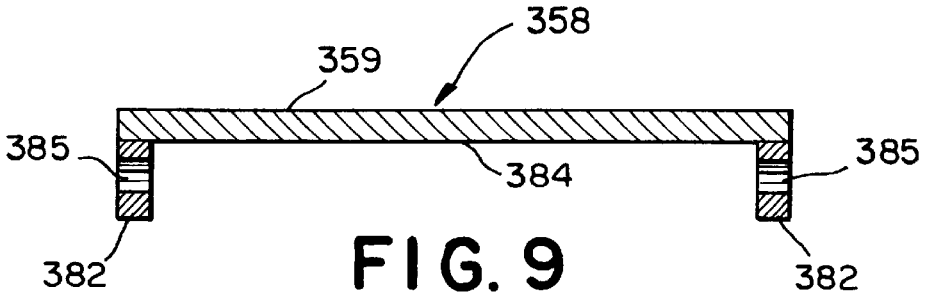
FIG. 9 is a cross-sectional view of the foot piece shown in FIG. 8 taken along the 9—9 line.

The footstool 342 further comprises a foot rest 358. As shown in FIGS. 8–10, the foot rest 358 has a generally flat upper surface 359. Bars 382, extending from the front end 361 to the rear end 360 of the foot rest 358 along the left and right sides of the foot rest 358, are positioned along a bottom surface 384 of the foot rest 358. Each bar 382 comprises a series of at least two bores 385 which extend completely through the bar 382 from the left side to the right side of the foot rest 358. The bores 385 on one bar 382 are arranged to be aligned with the bores 385 on the other bar 382. Accordingly, the foot rest 358 can be placed between the end pieces 376 such that a rod 386 can be positioned simultaneously through one of the bores 381 in one of the end pieces 376, one of the bores 385 in one of the bars 382, the diametrically opposed bore 381 in the other end piece 376, and the diametrically opposed bore 385 in the other bar 382. Accordingly, the height of the rear end 360 of the foot rest 358 above the ground is adjustable by inserting a first rod 386 through the appropriate bores 381 closest to the rear end 360 of the foot rest 358. Once the rear end 360 of the foot rest 358 has been positioned at the desired height, the slope of the foot rest 358 is adjusted by inserting a second rod 386 through bores 385 and appropriate bores 381 closer to the front end 361 of the foot rest 358.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An exercise system comprising:

a. a rocking chair having a seat and two runners operatively connected to the seat such that a user may sit on the seat and maintain a rocking motion, the chair comprising:

i. a back support positioned relative to the seat such that the user may sit on the seat with the user's back positioned against the back support; and ii. a frame positioned below the seat and above the runners for supporting the seat and back support above the runners, the comprising a support bar;

b. a rocking resistance operatively connected to the rocking chair, the rocking resistance comprising weights removably mountable on the support bar of the frame and having a magnitude sufficient for requiring an additional force to be applied to the rocking chair to maintain the rocking motion; and c. clamps for removably securing the weights to the frame.

2. An exercise system comprising:

a. a rocking chair having two runners;

b. a rocking resistance operatively connected to the rocking chair, the rocking resistance comprising at least one weight and a clamp for removably attaching the weight to the rocking chair and having a magnitude sufficient for requiring an additional force to be applied to the rocking chair to maintain a rocking motion; and c. a footstool comprising:

i. a foot rest having a foot support surface, the foot rest being positionable with respect to the rocking chair such that the feet of a user are supported on the foot support surface when the user is seated upon the rocking chair; and ii. an adjustment assembly on the foot rest for adjusting the height and angle of the foot rest.

3. An exercise system comprising:

a. a rocking chair comprising:

i. a seat;

ii. a frame positioned below the seat for supporting the seat about a fulcrum and above the ground, the frame including a support bar; and iii. two runners operatively connected to the seat such that a user may sit on the seat and maintain a rocking motion so that the seat rotates about the fulcrum;

b. a rocking resistance operatively connected to the rocking chair, the rocking resistance comprising weights removably mountable on the frame and having a magnitude sufficient for requiring an additional force to be applied to the rocking chair to maintain the rocking motion, wherein the weights are shaped to removably hook onto the support bar.

4. An exercise system comprising:

a. a rocking chair having a seat and two runners operatively connected to the seat such that a user may sit on the seat and maintain a rocking motion;

b. a frame positioned below the seat and above the runners for supporting the seat above the runners, the frame having a support bar; and c. a rocking resistance, operably connected to the rocking chair, having weights shaped to removably hook onto the support bar and having a magnitude sufficient for requiring an additional force to be applied to the rocking chair to maintain the rocking motion.

5. The exercise system of claim 4 comprising a clamp for removably securing the weights to the frame, the clamp having an attachment section for removable attachment relative to the frame and a u-shaped end clasp for engaging the weight to hold the weight in position.

6. An exercise system comprising:

a. a rocking chair comprising:

i. a seat;

ii. a frame positioned below the seat for supporting the seat about a fulcrum and above the ground; and iii. two runners operatively connected to the seat such that a user may sit on the seat and maintain a rocking motion so that the seat rotates about the fulcrum;

b. a rocking resistance, operably connected to the rocking chair, having weights removably mountable on the frame and having a magnitude sufficient for requiring an additional force to be applied to the rocking chair to maintain the rocking motion; and c. a clamp for removably securing the weights to the frame, the clamp having an attachment section for removable attachment relative to the frame and a u-shaped end clasp for engaging the weight to hold the weight in position.

7. An exercise system comprising:

a. a rocking chair having a seat and two runners operatively connected to the seat such that a user may sit on the seat and maintain a rocking motion wherein the runners are oriented relative to the seat so that the user's body weight is supported by the runners during the rocking motion thereby reducing resistance due to the user's body weight;

b. a frame for supporting the seat relative to the rocker, the frame having a support bar;

c. a rocking resistance, operably connected to the rocking chair, having weights shaped to removably hook onto the support bar and having a magnitude sufficient for requiring an additional force to be applied to the rocking chair to maintain the rocking motion; and d. a footstool operably associated with the chair, comprising:

i. a foot rest having a foot support surface, the foot rest being positionable with respect to the rocking chair such that the feet of the user are supported on the foot support surface when the user is seated upon the rocking chair; and ii. an adjustment assembly on the foot rest for adjusting the height and angle of the foot rest.

8. An exercise system comprising:

a. a rocking chair having a seat and two runners operatively connected to the seat such that a user may sit on the seat and maintain a rocking motion wherein the runners are oriented relative to the seat so that the user's body weight is supported by the runners during the rocking motion thereby reducing resistance due to the user's body weight;

b. a frame for supporting the seat relative to the rocker;

c. a rocking resistance, operably connected to the rocking chair, having weights removably mountable on the frame operatively connected to the rocking chair and having a magnitude sufficient for requiring an additional force to be applied to the rocking chair to maintain the rocking motion;

d. a clamp for removably securing the weights to the frame, the clamp having an attachment section for removable attachment relative to the frame and a u-shaped end clasp for engaging the weight to hold the weight in position; and e. a footstool comprising:

i. a foot rest having a foot support surface, the foot rest being positionable with respect to the rocking chair such that the feet of the user are supported on the foot support surface when the user is seated upon the rocking chair; and ii. an adjustment assembly on the foot rest for adjusting the height and angle of the foot rest.

9. An exercise system comprising:

a. a rocking chair having a seat and a support for supporting the seat in an orientation permitting the seat to be rocked by a user relative to the support to achieve a rocking motion;

b. a rocking resistance operatively connected to the rocking chair, the rocking resistance comprising at least one weight and a clamp for removably attaching the weight to the rocking chair and having a magnitude sufficient for requiring an additional force to be applied to the rocking chair for a rocking motion;

c. a resistance adjustment for the rocking resistance to enable the rocking resistance to be adjusted to a different amount of resistance to thereby require a different amount of force to be applied for the rocking motion; and d. a footstool operatively associated with the rocking chair comprising:

i. a foot rest having a foot support surface, the foot rest being positionable with respect to the rocking chair such that the feet of a user may be supported on the foot support surface when the user is seated upon the rocking chair; and ii. an adjustment assembly on the foot rest for adjusting the height and angle of the foot support surface to a selected position and for maintaining the foot support surface at the selected position during the rocking motion of the rocking chair.

* * * * *